US005783346A

United States Patent [19]

Jadwin et al.

[11] Patent Number: 5,783,346

[45] Date of Patent: Jul. 21, 1998

[54] TONER COMPOSITIONS INCLUDING POLYMER BINDERS WITH ADHESION PROMOTING AND CHARGE CONTROL MONOMERS

[75] Inventors: Thomas A. Jadwin, Rochester; Dinesh Tyagi, Fairport, both of N.Y.; Gary Lee Burroway, Doylestown, Ohio

[73] Assignees: Eastman Kodak Company, Rochester, N.Y.; Goodyear Tire & Rubber Company, Akron, Ohio

[21] Appl. No.: 779,190

[22] Filed: Jan. 6, 1997

Related U.S. Application Data

[63] Continuation of Ser. No. 611,582, Mar. 6, 1996, abandoned.

[51] Int. Cl.[6] ..... G03G 9/087

[52] U.S. Cl. ..... 430/106; 430/110

[58] Field of Search ..... 430/106, 109, 430/110

[56] References Cited

U.S. PATENT DOCUMENTS

| | | | |
|---|---|---|---|
| Re. 31,072 | 11/1982 | Jadwin et al. | 430/99 |
| 2,229,513 | 1/1941 | Lustig | 217/60 |
| 3,547,822 | 12/1970 | Miller | 252/62.1 |
| 3,632,512 | 1/1972 | Miller | 252/62.1 |
| 3,795,618 | 3/1974 | Kasper | 252/62.1 |
| 3,850,663 | 11/1974 | Hagenbach | 117/17.5 |
| 3,893,935 | 7/1975 | Jadwin et al. | 252/62.1 |
| 3,898,170 | 8/1975 | Kasper | 252/62.1 |
| 3,938,992 | 2/1976 | Jadwin et al. | 96/1 |
| 3,970,571 | 7/1976 | Olson et al. | 252/62.1 |
| 4,042,518 | 8/1977 | Jones | 252/62.6 |
| 4,076,857 | 2/1978 | Kasper et al. | 427/18 |
| 4,079,014 | 3/1978 | Burness et al. | 252/62.1 |
| 4,089,472 | 5/1978 | Siegel et al. | 241/5 |
| 4,160,644 | 7/1979 | Ryan | 23/230 B |
| 4,323,634 | 4/1982 | Jadwin | 430/110 |
| 4,394,430 | 7/1983 | Jadwin et al. | 430/110 |
| 4,414,152 | 11/1983 | Santilli et al. | 260/185 |
| 4,416,965 | 11/1983 | Sandhu et al. | 430/109 |
| 4,478,925 | 10/1984 | Miskinis | 430/137 |
| 4,517,272 | 5/1985 | Jadwin et al. | 430/110 |
| 4,545,060 | 10/1985 | Arnon | 375/14 |
| 4,546,060 | 10/1985 | Miskinis et al. | 430/108 |
| 4,624,907 | 11/1986 | Niimura et al. | 430/106 |
| 4,683,188 | 7/1987 | Suzuki et al. | 430/110 |
| 4,726,994 | 2/1988 | Yoerger | 428/403 |
| 4,758,491 | 7/1988 | Alexandrovich et al. | 430/110 |
| 4,780,553 | 10/1988 | Suzuki et al. | 556/26 |
| 4,814,250 | 3/1989 | Kwarta et al. | 430/110 |
| 4,833,060 | 5/1989 | Nair et al. | 430/137 |
| 4,834,920 | 5/1989 | Bugner et al. | 260/501.15 |
| 4,840,864 | 6/1989 | Bugner et al. | 430/110 |
| 5,192,637 | 3/1993 | Saito et al. | 430/109 |
| 5,217,836 | 6/1993 | Takiguchi et al. | 430/106.6 |
| 5,247,034 | 9/1993 | Mate et al. | 526/215 |
| 5,368,972 | 11/1994 | Yamashita et al. | 430/110 |

FOREIGN PATENT DOCUMENTS

| | | | |
|---|---|---|---|
| 797132 | 4/1978 | Belgium . | |
| 0 427 273 A2 | 5/1991 | European Pat. Off. . | |
| 57-149312 | 9/1982 | Japan . | |
| 59-050450 | 3/1984 | Japan . | |
| 60-057855 | 4/1985 | Japan . | |
| 1420839 | 1/1976 | United Kingdom . | |
| 1501065 | 2/1978 | United Kingdom | 430/115 |
| 2 011 101 | 7/1979 | United Kingdom . | |

OTHER PUBLICATIONS

U.S. Application 60/001,632 of Tyagi and Hadcock, filed 28 Jul. 1995 (now US SN 08/657,473, filed 29 May 1996).

Principles of Polymerization, G. Odian, McGraw–Hill, 1970, p. 291.

*Primary Examiner*—John Goodrow

*Attorney, Agent, or Firm*—Doreen Wells

[57] ABSTRACT

There is provided a toner composition which comprises a binder and a colorant, wherein said binder comprises a copolymer of a vinyl aromatic monomer; a second monomer selected from the group consisting of conjugated diene monomers or acrylate monomers selected from the group consisting of alkyl acrylate monomers and alkyl methacrylate monomers; a third monomer which is a crosslinking agent; a fourth monomer which is an adhesion promoting vinyl monomer containing a hydroxyl group; and a fifth monomer which is a charge control vinyl monomer containing an amine group. In a preferred embodiment, the binder further comprises the acid form of an amino acid soap which is the salt of an alkyl sarcosine having an alkyl group which contains from about 10 to about 20 carbon atoms. In additional preferred embodiments, the toner compositions of the invention further include a charge control agent. In other preferred embodiments, the toner compositions of the invention are used with a carrier. The toner compositions show a good combination of adhesion and charge stability.

15 Claims, No Drawings

TONER COMPOSITIONS INCLUDING POLYMER BINDERS WITH ADHESION PROMOTING AND CHARGE CONTROL MONOMERS

This a continuation of application Ser. No. 08/611,582, filed Mar. 6, 1996, now abandoned entitled "Toner Compositions Including Polymer Binders With Adhesion Promoting and Charge Control Monomers," incorporated herein by reference.

FIELD OF THE INVENTION

The invention relates to toner compositions including a colorant and a binder. The toner compositions are suitable for use in electrophotographic processes.

BACKGROUND OF THE INVENTION

In electrophotography (sometimes more generally referred to as electrostatography), an image comprising a pattern of electrostatic potential (also referred to as an electrostatic latent image), is formed on a surface of an electrophotographic element and is then developed into a toner image by contacting the latent image with an electrographic developer. If desired, the latent image can be transferred to another surface before development. The toner image is eventually transferred to a receiver, to which it is fused, typically by heat and pressure.

Toners typically contain a binder and other additives, such as colorants. Binders are generally polymeric and are selected so as to provide a balance between various conflicting constraints. For example, the melt viscosity and melt elasticity of a toner incorporating the binder must not be so low as to cause problems in transferring and fusing a toner image to a receiver.

In U.S. Pat. No. 3,938,992 there is disclosed a toner binder which is crosslinked. However, when a toner based on such a binder is used in a developer there is an increase in the developer resistance as the developer is continuously used over time to make many images. This leads to less than desired toner density as well as "line thinning" or the tendency of alpha numeric characters to become less legible. Further, these binders have a limited wettability to several compounds which are useful toner addenda, such as iron oxide.

One recently disclosed binder for toner compositions is described in U.S. Pat. No. 5,247,034. This reference discloses a binder which is prepared by an emulsion preparation technique using amino acid salts such as ammonium lauryl sarcosinate and sodium lauryl sarcosinate. While these binders are useful, because of very limited fusing latitude and high gloss, they can not be used in many toner applications in high speed machines.

An improvement to the toner compositions described in '034 is the subject of commonly assigned U.S. patent application Ser. No. 60/001,632 to Tyagi and Hadcock, filed 28 Jul. 1995. This application describes a binder for a toner which includes a crosslinking agent. This crosslinking agent improves various properties such as offset latitude and gloss.

Compositions of the type disclosed in the '034 patent, even with the addition of the crosslinker as described in U.S. Ser. No. 60/001,632, have less than desired adhesion when a toner containing the binder is fused to a receiver. Still further, these toner compositions have less than desired charge stability over time.

In U.S. Pat. No. 5,217,836 there is disclosed a toner with a binder having low residual monomer. There is no disclosure of a toner binder that provides a good combination of adhesion and charge stability.

Thus, there is a continuing need for further improvements in toner binders.

SUMMARY OF THE INVENTION

In accordance with the present invention, there is provided a toner composition which comprises a binder and a colorant, wherein said binder comprises:

a copolymer of a vinyl aromatic monomer; a second monomer selected from the group consisting of conjugated diene monomers or acrylate monomers selected from the group consisting of alkyl acrylate monomers and alkyl methacrylate monomers; a third monomer which is a crosslinking agent; a fourth monomer which is an adhesion promoting vinyl monomer containing a hydroxyl group; and a fifth monomer which is a charge control vinyl monomer containing an amine group.

In a preferred embodiment, the binder further comprises the acid form of an amino acid soap which is the salt of an alkyl sarcosine having an alkyl group which contains from about 10 to about 20 carbon atoms. In additional preferred embodiments, the toner compositions of the invention further include a charge control agent. In still other preferred embodiments, the toner compositions of the invention are used with a carrier.

The toner compositions of the present invention show an excellent combination of properties including improved charge stability over time and improved adhesion to receivers. In addition, the described binder is easy to pulverize to toner size particles. Finally, the binder used in the compositions of the invention display reduced "vinyl offset", the tendency of the image to offset to a vinyl sheet such as the inside cover of a vinyl-covered notebook.

DETAILED DESCRIPTION OF THE INVENTION

The binder used in the toner composition of the invention includes a copolymer that is made in accordance with the process described in U.S. Pat. No. 5,247,034 except that the copolymer includes a crosslinking agent, an adhesion promoting monomer and a charge control monomer.

The binders that are useful in the invention are copolymers vinyl aromatic monomers; conjugated dienes and acrylate monomers; crosslinking agents (and combinations thereof), the adhesion promoting monomer and the charge control monomer.

The useful vinyl aromatic monomers include styrene, 1-vinyl naphthalene; 2-vinyl naphthalene; 3-methyl styrene; 4-propyl styrene; t-butyl styrene; 4-cyclohexyl styrene; 4-dodecyl styrene; 2-ethyl-4-benzyl styrene; 4-(phenylbutyl) styrene; divinylbenzene and similar monomers. The currently preferred vinyl aromatic monomer is styrene.

The alkyl acrylate monomers that can be used generally have the structural formula:

$$CH_2{=}CH{-}\overset{\overset{\displaystyle O}{\|}}{C}{-}O{-}R$$

wherein R represents an alkyl group containing from 1 to about 10 carbon atoms. The alkyl group in such alkyl acrylate monomers will preferably contain from 2 to about 8 carbon atoms with alkyl groups which contain 4 carbon atoms being most preferred. Accordingly, ethyl acrylate, propyl acrylate, butyl acrylate, pentyl acrylate, hexyl acrylate and 2-ethyl acrylate are preferred. Most preferred is butyl acrylate.

The alkyl groups in such alkyl acrylate monomers can be straight chained or branched. Thus, normal-propyl acrylate, iso-propyl acrylate, normal-butyl acrylate or tertiary-butyl acrylate monomers can be used. Normal-butyl acrylate is the currently preferred alkyl acrylate monomer.

The alkyl methacrylate monomer that can be used normally have alkyl groups which contain from 1 to about 20 carbon atoms. The alkyl methacrylate monomer will preferably have an alkyl group which contains from 2 to about 12 carbon atoms. Some representative examples of alkyl methacrylate monomers include methyl methacrylate, butyl methacrylate, 2-ethylhexyl methacrylate, lauryl methacrylate and similar monomers.

The conjugated diene monomers which can be used typically contain from about 4 to about 10 carbon atoms. As a general rule, the conjugated diene monomer will contain from 4 to about 6 carbon atoms. Isoprene and 1,3-butadiene are the currently preferred conjugated diene monomers.

The crosslinking agent contains one or more compounds each having two or more double bonds capable of polymerization. Examples of suitable crosslinkers include: aromatic divinyl compounds such as divinyl benzene, and divinyl naphthalene; carboxylic acid esters having two double bonds such as ethylene glycol diacrylate, ethylene glycol dimethacrylate, and 1,3-butane diol dimethylacrylate; divinyl compounds such as divinyl aniline, divinyl ether, divinyl sulfide, and divinyl sulfone; and compounds having three or more vinyl groups. The currently preferred crosslinking agent is divinyl benzene.

The described crosslinked binder useful in this invention preferably has a tetrahydrofuran (THF) insoluble fraction ranging from 5 percent to 75 percent by weight of the entire binder. Thus, the exact amount of crosslinking agent is determined by the desired amount of insoluble fraction. The range of insoluble fraction present in the binder is a factor in determining the fusing quality obtained with the resulting toner as well as the gloss levels observed on fused images. But most importantly, the melt rheological behavior of the toner which is influenced by its insoluble fraction, determines the hot off-set propensity of the toner. (Hot off-set refers to the unwanted transfer of the toner melt to the fuser member.) The rheological requirements for a toner melt are affected by the type of fusing sub-system geometry, type of materials selected for fuser surface and the fusing speed. The rheological behavior of the polymer can be very easily performed on a dynamic mechanical rheometer. The results obtained on these binder at 150° C. and 1 rad/sec frequency indicate that the preferred complex melt viscosity (eta*) is in the range of 10,000 to 300,000 poise. Under similar conditions the storage modulus (G') would range from 5,000 to 275,000 dyne/cm$^2$. The higher the melt storage modulus, higher is the melt elasticity for the resulting toner.

A suitable method for gel fraction analysis involves combining the binder and spectral grade THF so as to produce a 1% solution of the binder which is stirred overnight. The resulting solution is then ultracentrifuged at 20,000 rpm for 3 hours and the supernatant is removed from the centrifuge tubes. About 5 grams of the supernatant is poured into a weighed aluminum dish and allowed to dry under vacuum at 80° C. The percentage of the binder that is insoluble (the "insoluble fraction" or "gel fraction") is determined by measuring the difference in the amount of dried polymer obtained in the dish and the amount obtained from a 1% solution.

The desired solubility properties can be achieved by variations in the method of making the polymer binders, by varying not only the monomer proportions but the concentration of chain transfer agent; the crosslinking agent; the initiator; the temperature; and combinations thereof. All of these adjustments can be easily made by those of skill in the polymer synthesis art to achieve the desired properties as set forth above.

The binders useful in the invention also comprise an adhesion promoting vinyl monomer containing a hydroxyl group. Useful monomers of this type include hydroxyalkyl (alkyl from 2 to about 22 carbon atoms) methacrylates and acrylates such as hydroxyethyl methacrylate; hydroxyethyl acrylate; hydroxypropyl methacrylate; hydroxypropyl acrylate; glycidyl methacrylate; hydroxymethyl styrene; hydroxybutyl methacrylate; and hydroxybutyl acrylate. Other useful adhesion promoting monomers include amide containing monomers such as methacrylamide and acrylamide; carboxylic acid containing monomers such as methacrylic acid and acrylic acid.

The fifth monomer of the binder is a charge a charge control vinyl monomer containing an amine group. Useful monomers of this type include 2-vinyl pyridine; 4-vinyl pyridine; dimethylaminoethyl methacrylate or acrylate; diethylaminoethyl methacrylate or acrylate; t-butylaminoethyl methacrylate or acrylate; aminoethyl methacrylate or acrylate; and diethylaminopropyl methacrylate or acrylate.

In the copolymer of the binder, the vinyl aromatic monomer can be present in an amount of from about 40 to about 90 percent by weight, preferably between about 50 and 80 percent by weight and still more preferably between about 60 and 80 percent by weight. The alkyl acrylate monomer or alkyl methacrylate monomer can be present in an amount from about 10 to about 40 percent by weight, preferably between about 15 to 35 percent by weight and still more preferably between about 18 to 30 percent by weight. The crosslinking agent can be present in an amount of from about 0.1 to about 3.0 percent by weight, preferably from about 0.2 to about 2.0 percent by weight and still more preferably 0.3 to 1.5 percent by weight. The adhesion promoting monomer can be present in an amount of from about 0.5 to about 10 percent by weight, preferably from about 1.0 to 6 percent by weight and still more preferably 2.0 to about 5.0 percent by weight. The charge control vinyl monomer can be present in an amount from about 0.3 to about 10 percent by weight, preferably from about 0.5 to 5 percent by weight and still more preferably 0.8 to about 4.0 percent by weight.

The copolymer binders that are useful in the invention are preferably made in the presence of an amino acid soap and this component then becomes a part of the binder and toner composition following isolation of the binder by appropriate methods. These amino acid soaps are typically salts of alkyl sarcosines. The alkyl sarcosine will typically have an alkyl group which contains from 10 to about 20 carbon atoms. Salts can be readily formed by reacting the alkyl sarcosines with an appropriate base, such as sodium, potassium, ammonium hydroxide, monoethanol amine, diethanol amine or triethanol amine. As a general rule, it is preferred to use sodium alkyl sarcosinates. Some representative examples of sodium alkyl sarcosinates which can be used include sodium lauryl sarcosinates, sodium cocyl sarcosinates, sodium myristol sarcosinates sodium oleoyl sarcosinates sodium stearyl sarcosinates and similar sarcosinates. Sodium lauryl sarcosinate is a particularly preferred amino acid soap for the compositions of the invention. Sodium lauryl sarcosinate is commercially available from W. R. Grace and Company as Hamposyl® L-30.

The amount of amino acid soap is as described in U.S. Pat. No. 5,247,034 at column 5. That is, the amount is preferably between about 0.5% to about 6% by weight of the binder but can be as high as about 15% by weight of the binder, the remainder of the binder being essentially the copolymer as described. At amino acid soap concentrations below about 0.5%, the advantageous effects, such as the resistance control, of a developer using the toner of the invention are greatly diminished. At concentrations above about 6%, no further advantages are seen in the performance of the toner composition. The currently preferred range is from about 1% to about 2% by weight of the binder.

Emulsifiers other than the preferred sarcosinate soaps can also be used. Emulsifiers which are capable of stabilizing emulsion polymerization are well known. Emulsifiers of this type are described for example in *Principles of Polymerization, G. Odian, McGraw-Hill,* 1970, at, for example page 291.

Another component of the toner is colorant: a pigment or dye. Suitable dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

A preferred but optional additive is a charge control agent. The term "charge control" refers to a propensity of a toner addenda to modify the triboelectric charging properties of the resulting toner. A very wide variety of charge control agents for positive charging toners are available. A large, but lesser number of charge control agents for negative charging toners are also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Positive charge control agents are preferred with the binders as described above. Particularly preferred charge control agents are shown in "Table B" immediately preceding the examples.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis. In the case of MICR (magnetic ink character recognition) toners, the weight percent of iron oxide could be as high as 40% by weight. In a particular embodiment of the invention, a waxy or olefinic additive is used at a concentration of about 0 to 5 weight percent relative to the weight of binder. A preferred additive of this type is a low molecular weight polypropylene wax such as a commercially available wax from Sanyo Chemical Corporations under the trade name Viscol®.

The developers can include carrier and the described toner. The carrier can be any of a variety of conductive materials; for example: particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; and 4,546,060. Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; 4,726,994; and 3,970,571. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles.

In a preferred embodiment, the carrier is sponge iron, which is sieved, oxidized and coated with fluorocarbon on a 0.1–0.3 weight percent basis.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

Toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The polymer binder used in the invention can be melt processed in a two roll mill or extruder. This procedure can include melt blending of other materials with the polymer, such as toner addenda and colorants. A pre-formed mechanical blend of particulate polymer particles, colorants and other toner additives can be prepared and then roll milled or extruded. The roll milling, extrusion, or other melt processing is performed at a temperature sufficient to achieve a uniformly blended composition. The resulting material, referred to as a "melt product" or "melt slab" is then cooled. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is cooled and then pulverized to a volume average particle size of from about 5 to 20 micrometers. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dispersed in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

In a particular embodiment, the developer contains from about 1 to about 5 percent by weight of toner and from about 95 to about 99 percent by weight of carrier particles. Usually, carrier particles are larger than toner particles. Conventional carrier particles have a particle size of from about 5 to about 1200 micrometers and are generally from 20 to 200 micrometers.

The developer can be made by simply mixing the toner and the carrier in a suitable mixing device. The components are mixed until the developer achieves a maximum charge. Useful mixing devices include roll mills and other high energy mixing devices.

The developer can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After imagewise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

In the examples, various charge control agents are used. The charge control agents are generically described in Table "B". These charge control agents are, for the most part, commercially available.

TABLE B

Charge Control Agents

| Agent | Description | Patent |
|---|---|---|
| CCA-1 | octadecyl dimethylbenzyl ammonium chloride | 4,394,430 |
| CCA-2 | dodecylbenzyl dimethyl ammonium 3-nitrobenzene sulfonate | 4,834,920<br>4,840,864 |

TABLE B-continued

Charge Control Agents

| Agent | Description | Patent |
|---|---|---|
| CCA-3 | 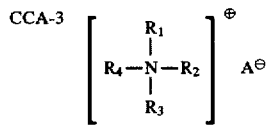 | 4,683,188<br>4,780,553 |
| CCA-4 | 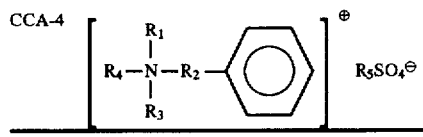 | 4,654,175<br>4,826,749<br>4,931,588 |

Comparative Example 1

No Adhesion Promotion (AP) or Charge Control (CC) Monomers

A toner sample was formulated by compounding on a two-roll mill 100 parts of cross-linked styrene-butyl acrylate polymer with 6 parts Black Pearls 430 carbon black (Cabot Corporation, Boston, Mass.) and 1.5 parts octadecyldimethylbenzyl ammonium chloride. The sample was then pulverized to yield a toner with an average particle size of 9 to 13 microns.

A developer was prepared by mixing three parts of toner with 97 parts of a poly(vinylidene fluoride) coated oxidized-sponge-iron carrier. The sponge-iron carrier may be obtained from Hoeganaes, Riverton, N.J.

We have found that the charge stability of a developer may be simulated by shaking it for extended periods of time with intermittent replacement of the toner. The charge stability of the developer was determined by placing it on a shaker and measuring the triboelectric charge after a total shaking time of 64 hours. The toner was removed from the developer and replaced with fresh toner after 16, 32 and 48 hours. Preferred developers will have a charge in the range of 8–35 microcoulombs/gram after 64 hours. The triboelectric charge after 64 hours for this developer was 5 μc/g as given in Table 1.

The fusing quality was evaluated on a hot-roller fixing device obtained from an Ektaprint 95™ fuser. The temperature was set at 190° C. and the speed at 150 mm/sec. Scotch Magic™ tape (12.5 mm width) (3M, St. Paul, Minn.) was firmly placed on the toned image and then slowly removed at a 180 degree angle. The percent of the toner remaining determines the fusing quality; a value of 100 indicates that no toner was removed by the tape and a value of 0 indicates that all of the toner was removed by the tape. An acceptable fusing quality for this toner was 50% as given in Table 1.

Comparative Examples 2–5 and Examples 1–8

In a similar manner the comparative examples and examples were prepared and tested. The only differences are in the polymers which contain either AP monomers, CC monomers, or both. The results are given in Table 1. It may be noted that only toners which contain both AP and CC monomers have a charge in the range of 8–35 uc/g and have a fusing quality of greater than 80 percent.

TABLE 1

| Example | Description | Adhesion Promoter Monomer | Amount (Wt. %) | Charge Control Monomer | Amount (Wt. %) | Charge @ 64 hr (μc/g) | Tape @ 190° C. (% remaining) |
|---|---|---|---|---|---|---|---|
| 1C | Control --no AP or CC monomers | — | — | — | | 5 | 50 |
| 2C | CC only | — | — | 2-vinyl pyridine | 3 | 22 | 70 |
| 3C | CC only | — | — | diethylaminoethyl methacrylate | 3 | 31 | 70 |
| 4C | AP only | 2-hydroxyethyl methacrylate | 3 | — | | −2 | 95 |
| 5C | AP only | 2-hydroxypropyl methacrylate | 3 | — | | 1 | 80 |
| 1 | AP + CC monomers | 2-hydroxyethyl methacrylate | 2 | 2-vinyl pyridine | 3 | 20 | 90 |
| 2 | AP + CC monomers | 2-hydroxyethyl methacrylate | 2 | 2-vinyl pyridine | 2 | 12 | 85 |
| 3 | AP + CC monomers | 2-hydroxyethyl methacrylate | 3 | 2-vinylpyridine | 3 | 18 | 95 |
| 4 | AP + CC monomers | 2-hydroxyethyl methacrylate | 2.85 | 2-vinylpyridine | 1.9 | 15 | 90 |
| 5 | AP + CC monomers | 2-hydroxyethyl methacrylate | 3 | diethylaminoethyl methacrylate | 2 | 29 | 99 |
| 6 | AP + CC monomers | 2-hydroxyethyl methacrylate | 3 | diethylaminoethyl methacrylate | 1 | 20 | 95 |
| 7 | AP + CC monomers | 2-hydroxyethyl methacrylate | 3 | diethylaminoethyl methacrylate | 0.5 | 12 | 99 |
| 8 | AP + CC monomers | 2-hydroxypropyl methacrylate | 3 | diethylaminoethyl methacrylate | 1 | 18 | 95 |

The invention has been described with particular reference to preferred embodiments thereof but it will be understood that variations and modifications can be effected within the spirit and scope of the invention.

We claim:

1. A toner composition which comprises a binder and a colorant, wherein said binder comprises a copolymer of a vinyl aromatic monomer; a second monomer selected from the group consisting of conjugated diene monomers or acrylate monomers selected from the group consisting of alkyl acrylate monomers and alkyl methacrylate monomers; a third monomer which is a crosslinking agent; a fourth monomer which is an adhesion promoting vinyl monomer containing a hydroxyl group; and a fifth monomer which is a charge control vinyl monomer containing an amine group.

2. The toner composition of claim 1 wherein said binder further comprises the acid form of an amino acid soap which is the salt of an alkyl sarcosine having an alkyl group which contains from about 10 to about 20 carbon atoms.

3. The toner composition according to claim 2 wherein said amino acid soap is sodium lauryl sarcosinate.

4. The toner composition according to claim 1 wherein said compositions further comprises a charge control agent.

5. The toner composition according to claim 1 further comprising a carrier.

6. The toner composition according to claim 1 wherein said vinyl aromatic monomer is styrene and said alkyl acrylate monomer is butyl acrylate.

7. The toner composition according to claim 1 wherein said crosslinking agent is divinyl benzene.

8. The toner composition according to claim 1 wherein said adhesion promoting monomer is a hydroxy containing monomer.

9. The toner composition according to claim 8 wherein said adhesion promoting monomer is hydroxyethyl methacrylate.

10. The toner composition according to claim 8 wherein said adhesion promoting monomer is hydroxypropyl methacrylate.

11. The toner composition according to claim 1 wherein said charge control vinyl monomer is 2-vinyl pyridine.

12. The toner composition according to claim 1 wherein said charge control vinyl monomer is diethylaminoethyl methacrylate.

13. The toner composition according to claim 1 wherein said binder is a copolymer of styrene, n-butyl acrylate, divinyl benzene, hydroxyethyl methacrylate and 2-vinyl pyridine.

14. The toner composition according to claim 1 wherein said vinyl aromatic monomer is present in an amount of from about 40 to 90 percent by weight of said copolymer; said of alkyl acrylate monomer or alkyl methacrylate monomer is present in an amount from about 10 to about 40 percent by weight; said crosslinking agent is present in an amount of from about 0.1 to about 3.0 percent by weight; said adhesion promoting monomer is present in an amount of from about 0.5 to about 10 percent by weight; and said charge control vinyl monomer is present in an amount of from about 0.3 to about 10 percent by weight.

15. The toner composition according to claim 1 wherein said colorant is carbon.

* * * * *